US010025219B2

(12) United States Patent
Endo et al.

(10) Patent No.: US 10,025,219 B2
(45) Date of Patent: Jul. 17, 2018

(54) PRINTING APPARATUS AND SUBSTRATE FOR DRIVING LIGHT-EMITTING ELEMENT

(71) Applicant: CANON KABUSHIKI KAISHA, Tokyo (JP)

(72) Inventors: Wataru Endo, Tokyo (JP); Hiroyuki Nakamura, Atsugi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/254,851

(22) Filed: Sep. 1, 2016

(65) Prior Publication Data

US 2017/0090336 A1 Mar. 30, 2017

(30) Foreign Application Priority Data

Sep. 24, 2015 (JP) ..... 2015-187439

(51) Int. Cl.
*G03G 15/043* (2006.01)
*H05B 37/02* (2006.01)

(52) U.S. Cl.
CPC ..... *G03G 15/043* (2013.01); *H05B 37/0227* (2013.01)

(58) Field of Classification Search
CPC ..... G03G 15/04054; G03G 15/04036; G03G 15/043; H05B 37/0227
USPC ..... 399/4
See application file for complete search history.

(56) References Cited

U.S. PATENT DOCUMENTS 5,373,518 A 12/1994 Uchiyama et al. ..... 372/38
9,459,552 B2 10/2016 Endo ..... G03G 15/04036
2013/0328992 A1* 12/2013 Hayakawa ..... G03G 15/80 347/224
2014/0071219 A1* 3/2014 Kurashima ..... G03G 15/04054 347/224

FOREIGN PATENT DOCUMENTS

JP 2012-038959 2/2012

* cited by examiner

*Primary Examiner* — Billy Lactaoen
(74) *Attorney, Agent, or Firm* — Fitzpatrick, Cella, Harper & Scinto

(57) ABSTRACT

A printing apparatus comprising a light-emitting element, a light-receiving element configured to output a monitor current based on a light-emitting amount from the light-emitting element, a comparison unit connected to the light-receiving element and configured to compare the monitor current with a reference current, a driving unit configured to drive the light-emitting element based on the comparison result, a current generation unit configured to generate a first current, and a conversion unit arranged in a path between the current generation unit and the comparison unit, the conversion unit outputting, upon receiving a control signal, the reference current based on the control signal and the first current.

18 Claims, 3 Drawing Sheets

PRINTING APPARATUS AND SUBSTRATE FOR DRIVING LIGHT-EMITTING ELEMENT

BACKGROUND OF THE INVENTION

Field of the Invention

The present invention relates to a printing apparatus and a substrate for driving a light-emitting element.

Description of the Related Art

An electrophotographic printing apparatus (such as a laser printer) includes, for example, a light-emitting element for irradiating a photosensitive drum with a laser beam. First, the light-emitting element irradiates, based on printing data, the charged photosensitive drum with the laser beam. This lowers a potential of a portion in the photosensitive drum irradiated with the laser beam, and a potential distribution based on the printing data is formed on the photosensitive drum (latent image). Next, toner as toner particles is attached to this photosensitive drum. The toner attached to the photosensitive drum follows (develops) the potential distribution on the photosensitive drum. Then, an image according to the printing data is formed on a printing medium such as a paper sheet by transferring the toner that has attached to the photosensitive drum to the printing medium.

Some printing apparatuses control driving of the light-emitting element so as to maintain the laser beam of a suitable light amount (target value). This control is also referred to as Auto Power Control (APC). A printing apparatus having an APC function includes, for example, a light-emitting element, a light-receiving element which receives light from the light-emitting element, a monitor which receives a current from the light-receiving element, and a driving unit which drives the light-emitting element. The driving unit holds a monitoring result from the monitor in APC and drives the light-emitting element with a driving force based on the held monitoring result in subsequent printing.

FIG. 1 in Japanese Patent Laid-Open No. 2012-38959 discloses the circuit arrangement of a feedback system with a current-current converter being arranged between a comparator corresponding to the above-described monitor and a light-receiving element. More specifically, in APC, a result obtained by converting a current (monitor current) from the light-receiving element with the current-current converter is fed back to the comparator. According to this arrangement, however, a delay is caused in the above-described feedback system by converting the monitor current with the current-current converter.

SUMMARY OF THE INVENTION

The present invention provides a technique advantageous in reducing a delay in a feedback system in a printing apparatus having an APC function.

One of the aspects of the present invention provides a printing apparatus, comprising a light-emitting element, a light-receiving element configured to output a monitor current having a value corresponding to a light-emitting amount of the light-emitting element, a comparison unit connected to the light-receiving element and configured to compare the monitor current with a reference current, a driving unit configured to drive the light-emitting element based on a comparison result by the comparison unit, a current generation unit configured to generate a first current having a first current value, and a conversion unit arranged in a path between the current generation unit and the comparison unit, and configured to output, upon receiving a control signal, a second current having a second current value as the reference current, wherein a ratio of the second current value to the first current value is set based on the control signal.

Further features of the present invention will become apparent from the following description of exemplary embodiments with reference to the attached drawings.

DESCRIPTION OF THE EMBODIMENTS

First Embodiment

Figure 1:
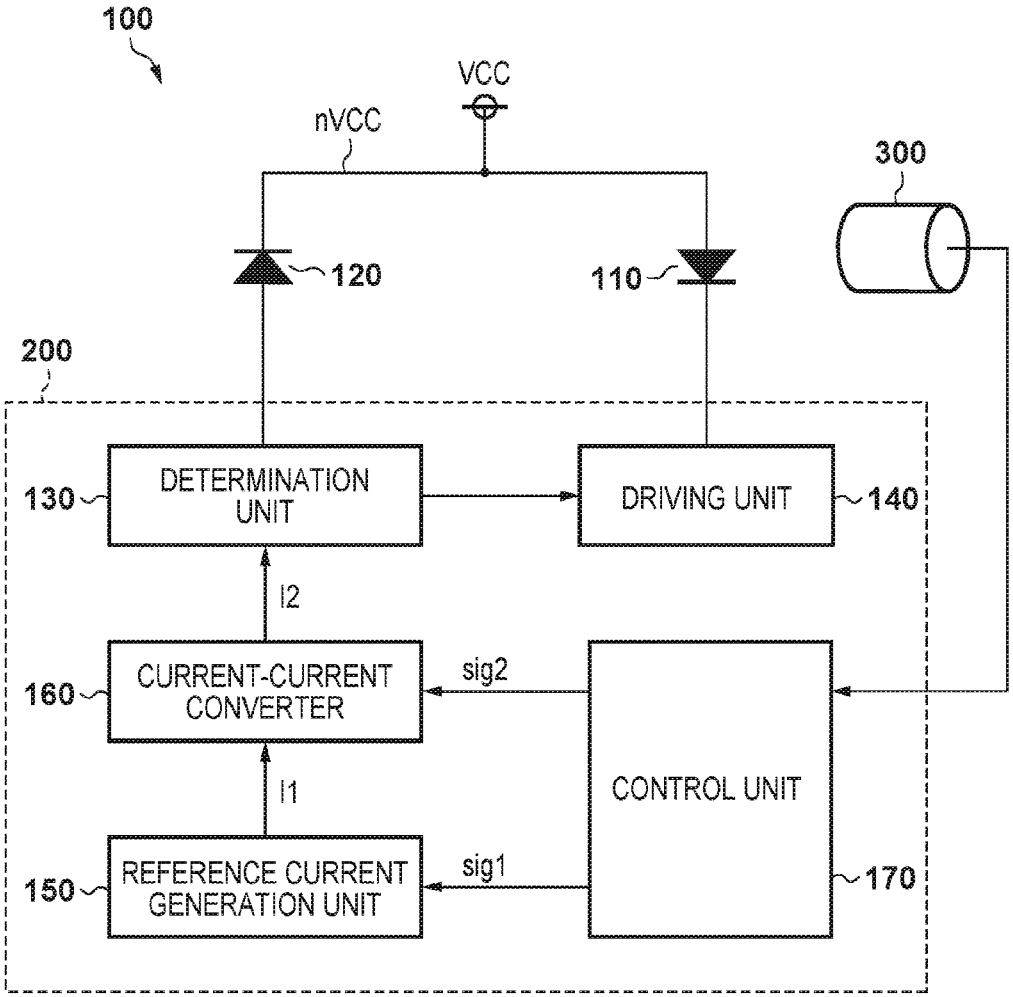
FIG. 1 is a diagram for explaining an example of the entire arrangement of a printing apparatus.

FIG. 1 shows an example of the entire arrangement of a printing apparatus 100 according to the first embodiment. The printing apparatus 100 is an electrophotographic printing apparatus (for example, a laser printer). The printing apparatus 100 includes, for example, a light-emitting element 110, a light-receiving element 120, a substrate 200 for driving the light-emitting element, and a photosensitive drum 300. The substrate 200 includes, for example, a determination unit 130, a driving unit 140, a reference current generation unit 150, a current-current converter 160, and a control unit 170.

The light-emitting element 110 is arranged such that its anode is connected to a power supply node nVCC through which a power supply voltage VCC propagates, and its cathode is connected to the driving unit 140. The light-emitting element 110 is, for example, a laser diode, emits light upon being driven by the driving unit 140, and irradiates the photosensitive drum 300 with the emitted light (laser beam).

The light-receiving element 120 is arranged such that its cathode is connected to the power supply node nVCC, and its anode is connected to the determination unit 130. The light-receiving element 120 is a photoelectric conversion element such as a photodiode, receives the light emitted by the light-emitting element 110, and outputs a current Im of a value corresponding to the amount of that light as a monitor current. More specifically, the light-receiving element 120 is in a reverse bias state at the time of an operation including APC, and charges generated in the light-receiving element 120 by the light emitted by the light-emitting element 110 form the monitor current Im of a value corresponding to that amount.

For example, the control unit 170 is a CPU, a processor, or the like configured to control a printing operation, and controls the reference current generation unit 150 and the current-current converter 160 by control signals sig1 and sig2, respectively. For example, the reference current generation unit 150 generates a reference current I1 (first current) as a constant current and outputs, to the current-current converter 160, the reference current I1 generated in accordance with the control signal sig1 from the control unit 170. In another example, the reference current generation unit 150 may generate the reference current I1 in accordance with the control signal sig1 and output the generated reference current I1 to the current-current converter 160.

The current-current converter 160 is arranged in a path between the reference current generation unit 150 and the determination unit 130, and receives the reference current I1 from the reference current generation unit 150. Then, the current-current converter 160 outputs, as a reference current (second current), a current I2 of a value obtained by multiplying a value of the reference current I1 by the ratio according to the control signal sig2 from the control unit 170. The current-current converter 160 may simply be referred to as a "converter". The reference current I2 may correspond to a target value of the light-emitting amount of the light-emitting element 110 and be referred to as a "target current". Note that the control signal sig2 can include a plurality of signals, a detail of which will be described later.

The determination unit 130 is connected to the light-receiving element 120 and the current-current converter 160, and determines, based on the monitor current Im and the reference current I2, whether the light-emitting amount of the light-emitting element 110 reaches the target value. The determination unit 130 includes a comparator or the like, compares the monitor current Im with the reference current I2 by the comparator, and determines, based on that comparison result, whether the light-emitting amount of the light-emitting element 110 reaches the target value, a detail of which will be described later.

The driving unit 140 drives the light-emitting element 110 based on the above-described comparison result. More specifically, the driving unit 140 includes, for example, an information holding unit (for example, a sampling circuit) and a driver (both of which are not shown). Then, the driving unit 140 holds, in the information holding unit, an output from the determination unit 130 upon completion of APC as information for making the light-emitting amount of the light-emitting element 110 reach the target value. In subsequent printing, the driver drives the light-emitting element 110 by using a driving signal in accordance with the information held in the information holding unit.

That is, the light-emitting element 110, the light-receiving element 120, the determination unit 130, the driving unit 140, the reference current generation unit 150, and the current-current converter 160 form a feedback system for bringing the light-emitting amount of the light-emitting element 110 closer to the target value, and APC is implemented by this arrangement. An example of the arrangement of an anode-driven type laser has been described here. However, the arrangement of a cathode-driven type laser may also be possible.

Figure 2A:
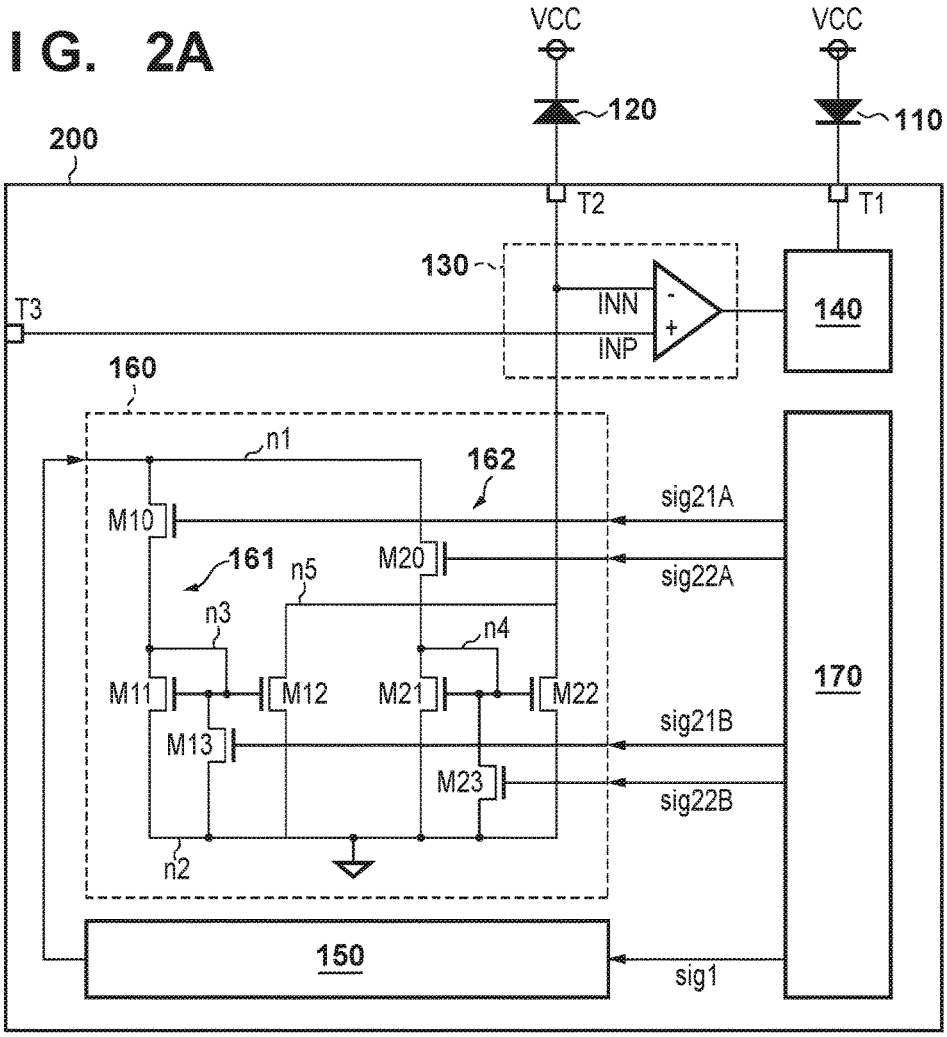
FIGS. 2A and 2B are a diagram and a timing chart, respectively, for explaining a practical example of the arrangement of the printing apparatus.

FIG. 2A shows an example of the arrangement of the printing apparatus 100 more specifically. The substrate 200 includes terminals T1 to T3 (electrode pads). The first terminal T1 is connected to the light-emitting element 110, and the driving unit 140 drives the light-emitting element 110 via the terminal T1. The second terminal T2 is connected to the light-receiving element 120, and the substrate 200 receives the monitor current Im via the terminal T2. The third terminal T3 receives a reference voltage Vref as a constant voltage.

For example, the current-current converter 160 includes a current mirror circuit formed by transistors M10 to M13 and M20 to M23, and is controlled by the control signal sig2 (more specifically, control signals sig21A, sig21B, sig22A, and sig22B). For example, a NMOS transistor can be used for this transistor M10 or the like. The transistors M10 to M13 form a first current mirror circuit 161. The transistors M20 to M23 form a second current mirror circuit 162.

Assume that a node through which the reference current I1 from the reference current generation unit 150 flows is a node n1. Assume that a ground node is a node n2. Assume that a node positioned between the node n1 and the node n2 is a node n3. Assume that a node positioned between the node n1 and the node n2, and different from the node n3 is a node n4. Assume that a node through which the reference current I2 flows and which corresponds to the output terminal of the current-current converter 160 is a node n5.

With respect to the current mirror circuit 161, the transistor M10 is arranged such that its drain is connected to the node n1, its source is connected to the node n3, and its gate receives the control signal sig21A. The transistor M11 is arranged such that its drain and gate are connected to the node n3, and its source is connected to the node n2. The transistor M12 is arranged such that its drain is connected to the node n5, its source is connected to the node n2, and its gate is connected to the node n3. The reference current I2 of a value (first current value) obtained by multiplying the value of the reference current I1 flowing through the transistor M11 by the size ratio of the transistor M11 and the transistor M12 flows through the transistor M12. This reference current I2 may be referred to as a "reference current I21" hereinafter for the sake of distinction. The transistor M13 is configured to fix, at L, a potential of the node n3 obtained when the current mirror circuit 161 is inactive, and is arranged such that its drain is connected to the node n3, its source is connected to the node n2, and its gate receives the control signal sig21B.

With respect to the current mirror circuit 162, the transistor M20 is arranged such that its drain is connected to the node n1, its source is connected to the node n4, and its gate receives the control signal sig22A. The transistor M21 is arranged such that its drain and gate are connected to the node n4, and its source is connected to the node n2. The transistor M22 is arranged such that its drain is connected to the node n5, its source is connected to the node n2, and its gate is connected to the node n4. The reference current I2 of a value (second current value) obtained by multiplying the value of the reference current I1 flowing through the transistor M21 by the size ratio of the transistor M21 and the transistor M22 flows through the transistor M22. This reference current I2 may be referred to as a "reference current I22" hereinafter for the sake of distinction. The transistor M23 is configured to fix, at L, a potential of the node n4 obtained when the current mirror circuit 162 is inactive, and is arranged such that its drain is connected to the node n4, its source is connected to the node n2, and its gate receives the control signal sig22B.

The size ratio of the transistor M11 and the transistor M12 can correspond to the current conversion ratio of the current-current converter 160 and also be expressed as the "mirror ratio" of the current mirror circuit 161. The same also applies to the size ratio of the transistor M21 and the transistor M22.

Figure 2B:
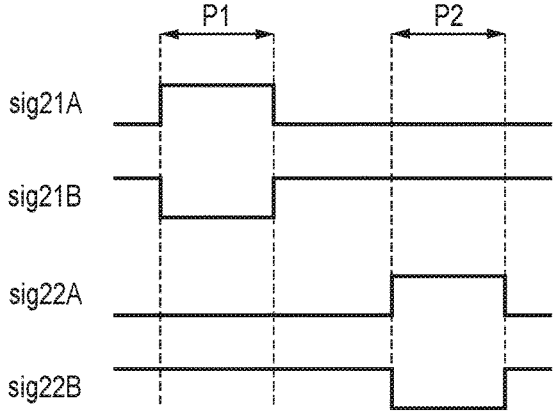

FIG. 2B is a timing chart showing the operation of the current-current converter 160. According to this arrangement example, the current-current converter 160 outputs the reference current I21 or I22 of a value obtained by multiplying the value of the reference current I1 by the ratio according to the control signals sig21A, sig21B, sig22A, and sig22B. For example, in a period P1 during which the control signals sig21A and sig22B are at H (high level), and the control signals sig21B and sig22A are at L (low level), the current mirror circuit 161 becomes active, and the current mirror circuit 162 becomes inactive. In the period P1, the reference current I21 of the first current value flows through the node n5. On the other hand, in a period P2 during which the control signals sig21A and sig22B are at L, and the control signals sig21B and sig22A are at H, the current mirror circuit 161 becomes inactive, and the current mirror circuit 162 becomes active. In the period P2, the reference current I22 of the second current value flows through the node n5.

That is, based on the control signal sig2, the current-current converter 160 can output the reference current I2 (one of the reference currents I21 and I22) when one of the first current mirror circuits 161 and 162 becomes active. While one APC operation is performed (that is, in a period from the start of APC to time at which the light-emitting amount of the light-emitting element 110 reaches the target value), the logic level of each of the control signals sig1 and sig2 is fixed, and the value of the reference current I2 is fixed.

Referring back to FIG. 2A, the determination unit 130 includes, for example, a comparator having an inverting input terminal INN (the first input terminal indicated by "−" in FIG. 2A) and a non-inverting input terminal INP (the second input terminal indicated by "+" in FIG. 2A). The inverting input terminal INN, the anode of the light-receiving element 120, and the node n5 are connected to each other (for example, they are connected to each other by a conductive member such as an interconnection pattern or a contact plug) and are substantially at the same potential. The non-inverting input terminal INP receives the reference voltage Vref via the terminal T3.

For example, the reference voltage Vref can fall between the power supply voltage VCC and a voltage (the voltage of the node n2) VSS for ground, and fall within a range in which the current mirror circuit 161 (or 162) can output the reference current I21 (or I22) appropriately. More specifically, the reference voltage Vref can fall within a range in which the transistor M11 or the like that forms the first current mirror circuits 161 and 162 can perform a source follower operation.

For example, when the current value of the monitor current Im of the light-receiving element 120 is larger than the current value of the reference current I2 (I21 or I22) (that is, when the light-emitting amount of the light-emitting element 110 is larger than the target value), the potential of the inverting input terminal INN increases to be higher than the reference voltage Vref. This can be considered that the input capacitance of the inverting input terminal INN is charged by a difference (Im−I2) between the monitor current Im and the reference current I2 (<Im). From another viewpoint, it may be considered that the charges increase in the light-receiving element 120 because the amount of the charges generated in the light-receiving element 120 per unit time is larger than the reference current I2, and the increasing charges increase the potential of the inverting input terminal INN. The driving unit 140 reduces a driving force for driving the light-emitting element 110 upon receiving an output from the comparator of the determination unit 130 at this time.

On the other hand, when the current value of the monitor current Im is smaller than the current value of the reference current I2 (that is, when the light-emitting amount of the light-emitting element 110 is smaller than the target value), the potential of the inverting input terminal INN decreases to be lower than the reference voltage Vref. This can be considered that discharge from the input capacitance of the inverting input terminal INN occurs by a difference (I2−Im) between the monitor current Im and the reference current I2. From another viewpoint, it may be considered that the charges decrease in the light-receiving element 120 because the amount of the charges generated in the light-receiving element 120 per unit time is smaller than the reference current I2, and the decreasing charges decrease the potential of the inverting input terminal INN. The driving unit 140 increases the driving force for driving the light-emitting element 110 upon receiving an output from the comparator of the determination unit 130 at this time.

In this embodiment, the determination unit 130 compares the monitor current Im with the reference current I2 by this arrangement and based on that comparison result, performs feedback control for making the light-emitting amount of the light-emitting element 110 reach the target value. APC is implemented by this feedback control. The potential of the inverting input terminal INN becomes at the same potential as the reference voltage Vref when the current value of the monitor current Im and the current value of the reference current I2 become equal to each other. When such a state is obtained, it may be determined that the light-emitting amount of the light-emitting element 110 reaches the target value. Note that in feedback control, the potential of the inverting input terminal INN and the reference voltage Vref need not always be set at the same potential, but the light-emitting amount of the light-emitting element 110 can be changed in accordance with the comparison result between the monitor current Im and the reference current I2.

The control unit 170 controls the current-current converter 160. More specifically, the control unit 170 controls the current conversion ratio (may also be referred to as a "gain") of the current-current converter 160 by making one of the first current mirror circuits 161 and 162 active, and outputs the reference current I2 (I21 or I22). For example, the control unit 170 may include a measurement unit (not shown), measure the used amount (the number of rotations, the degree of deterioration, or the like) of the photosensitive drum 300 by the measurement unit, and control the current-current converter 160 by using the control signal sig2 based on that measurement result.

As described above, according to this arrangement example, the current-current converter 160 is arranged in the path between the reference current generation unit 150 and the determination unit 130, converts (or modulates) the reference current I1 from the reference current generation unit 150 based on the control signal sig2, and outputs the converted current to one of the reference currents I21 and I22. The current conversion ratio of the current-current converter 160 is decided by the control signal sig2 and, for example, may be adjusted appropriately for each APC (for example, APC may be performed in accordance with the used amount of the photosensitive drum 300). This makes it possible to bring the light-emission amount of the light-emitting element 110 closer to the corresponding target value. According to this arrangement example, a processing target is not the monitor current Im but the reference current I1, and another current-current converter need not be arranged in the path between the light-receiving element 120 and the determination unit 130. Therefore, this arrangement example is advantageous in preventing a feedback delay of the monitor current Im to the determination unit 130.

In particular, according to this arrangement example, the variation amount of the feedback delay when the current conversion ratio of the current-current converter 160 is changed can be suppressed as compared with a case in which the other current-current converter capable of changing the current conversion ratio is arranged between the light-receiving element 120 and the determination unit 130. This is advantageous in preventing oscillation or the like of the feedback system caused by a change in an operating frequency band and stabilizing APC. In another example, the other current-current converter may be arranged between the light-receiving element 120 and the determination unit 130 (that is, conversion processing may be performed on the monitor current Im). In this case, however, APC can be stabilized by adjusting the current conversion ratio for both the monitor current Im and the reference current I1.

The mode has been exemplified above in which the current-current converter 160 outputs one of two reference currents I21 and I22. However, the current-current converter 160 may output one of three or more reference currents different in current value. In this case, the current-current converter 160 may be configured to include three or more current mirror circuits and output one of three or more reference currents described above by making one of the current mirror circuits active. In another example, the current-current converter 160 may be configured to output one of a plurality of reference currents different in current value by making at least one (two or more is also possible) of a plurality of current mirror circuits active.

Second Embodiment

The second embodiment will be described with reference to FIG. 3. This embodiment is different from the aforementioned first embodiment in that a light-emitting element 110, a determination unit 130, and a driving unit 140 form a unit group G, and a substrate 200 has a plurality of groups G. Assume that the number of groups is two here for the sake of descriptive simplicity. Also assume that the two groups G include a "group Ga" and a "group Gb", respectively, for the sake of distinction. As exemplified in FIG. 3, a reference current generation unit 150 and a current-current converter 160 can be arranged in correspondence with each of the groups Ga and Gb.

Figure 3:
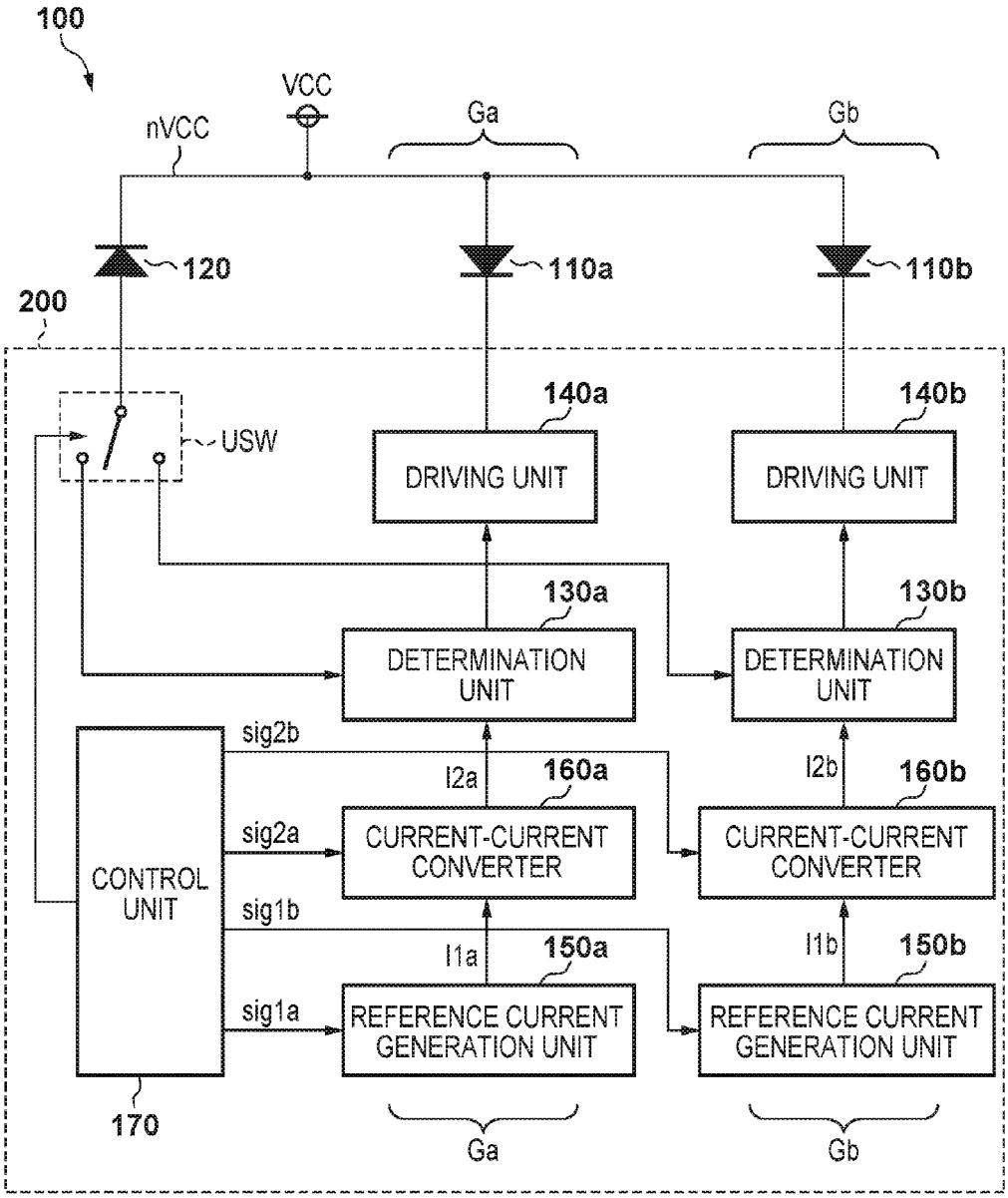
FIG. 3 is a diagram for explaining a practical example of the arrangement of a printing apparatus.

Note that in FIG. 3, reference numeral of each element or each unit such as the above-described light-emitting element 110 is represented by affixing "a" or "b" to it in order to make a distinction of whether each element or each unit belongs to one of the groups Ga and Gb. For example, the light-emitting element 110 in the group Ga is referred to as a "light-emitting element 110*a*" (the same also applies to the other elements and units).

For example, the groups Ga and Gb correspond to different colors in a printing apparatus 100 capable of color printing. Hence, the number of groups corresponds to the number of colors. For example, when printing can be performed in four colors of Y (yellow), M (magenta), C (cyan), and K (black), the number of groups G may be four, or two substrates 200 each having two groups G may be prepared in another example.

Referring to FIG. 3, a switch unit USW is arranged in a path between a light-receiving element 120 and both determination units 130*a* and 130*b*, and connects the light-receiving element 120 to one of the determination units 130*a* and 130*b*. According to this arrangement, it is possible to perform APC for the group Ga and APC for the group Gb sequentially by controlling the switch unit USW. More specifically, for example, the switch unit USW electrically connects the light-receiving element 120 and the determination unit 130*a* to adjust the light-emitting amount of the light-emitting element 110*a* by APC for the group Ga, and then electrically connects the light-receiving element 120 and the determination unit 130*b*.

According to this embodiment, the same effect as in the first embodiment can also be obtained in the printing apparatus 100 (for example, the printing apparatus 100 capable of color printing) having the plurality of groups G formed by the light-emitting element 110, the determination unit 130, and the driving unit 140.

(Others)

Some preferred embodiments have been exemplified above. However, the present invention is not limited to these embodiments. Some of the embodiments may be changed without departing from the scope of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-187439, filed on Sep. 24, 2015, which is hereby incorporated by reference herein in its entirety.

What is claimed is:

1. A printing apparatus comprising:

a light-emitting element;

a light-receiving element having an output terminal configured to output the monitor current, and configured to output, from the output terminal, a monitor current having a value corresponding to a light-emitting amount of the light-emitting element;

a comparison unit having a first input terminal and a second input terminal and configured to compare the monitor current with a reference current;

a driving unit configured to drive the light-emitting element based on a comparison result by the comparison unit;

a current generation unit configured to generate a first current having a first current value; and a conversion unit having an input terminal configured to receive the first current, an input terminal configured to receive a control signal, and an output terminal configured to output, as the reference current, a second current having a second current value, wherein a ratio of the second current value to the first current value is set based on the control signal, and wherein the output terminal of the light-receiving element, the output terminal of the conversion unit, and the first input terminal of the comparison unit are connected to each other, and the second input terminal receives a reference voltage.

2. A printing apparatus comprising:

a light-emitting element;

a light-receiving element configured to output a monitor current having a value corresponding to a light-emitting amount of the light-emitting element;

a comparison unit connected to the light-receiving element and configured to compare the monitor current with a reference current;

a driving unit configured to drive the light-emitting element based on a comparison result by the comparison unit;

a current generation unit configured to generate a first current having a first current value; and a conversion unit arranged in a path between the current generation unit and the comparison unit, and configured to output, upon receiving a control signal, a second current having a second current value as the reference current, wherein a ratio of the second current value to the first current value is set based on the control signal, and wherein the conversion unit includes at least two current mirror circuits each receiving the first current.

3. The apparatus according to claim 2, wherein each of the at least two current mirror circuits becomes active based on the control signal.

4. The apparatus according to claim 3, wherein the conversion unit includes a switch configured to connect the current generation unit and one of the at least two current mirror circuits, and the control signal controls the switch to be turned on or off.

5. The apparatus according to claim 4, wherein the comparison unit includes a first input terminal, and each output node of the at least two current mirror circuits is connected to the first input terminal.

6. The apparatus according to claim 5, wherein the at least two current mirror circuits have mirror ratios different from each other.

7. The apparatus according to claim 6, wherein the comparison unit includes the first input terminal and a second input terminal, an output terminal configured to output the monitor current of the light-receiving element, an output terminal configured to output the reference current of the conversion unit, and the first input terminal are connected to each other, and the second input terminal receives a reference voltage.

8. The apparatus according to claim 1, further comprising a plurality of groups each including the light-emitting element, the comparison unit, and the driving unit, and a selection switch configured to selectively connect, to the light-receiving element, the comparison unit in one of the plurality of groups.

9. The apparatus according to claim 1, further comprising a photosensitive drum configured to receive light from the light-emitting element, and a control unit configured to control the conversion unit by using, as the control signal, a signal corresponding to a used amount of the photosensitive drum.

10. A printing apparatus comprising:

a light-emitting element;

a light-receiving element having an output terminal configured to output the monitor current, and configured to output, from the output terminal, a monitor current having a value corresponding to a light-emitting amount of the light-emitting element;

a current generation unit configured to generate a first current having a first current value;

a conversion unit having an output terminal and configured to output, from the output terminal thereof, a second current having a second current value as a reference current upon receiving a control signal and the first current, a ratio of the second current value to the first current value being set based on the control signal;

a comparator which includes a first input terminal connected to both the output terminal of the light-receiving element and the output terminal of the conversion unit, and a second input terminal configured to receive a reference voltage; and a driving unit configured to drive the light-emitting element based on an output from the comparator.

11. A substrate for driving a light-emitting element, the substrate comprising:

a first terminal configured to output a driving signal for driving the light-emitting element;

a second terminal configured to receive a monitor current from a light-receiving element;

a comparison unit having a first input terminal and a second input terminal and configured to compare the monitor current with a reference current;

a driving unit configured to output the driving signal to the first terminal based on a comparison result by the comparison unit;

a current generation unit configured to generate a first current having a first current value; and a conversion unit having an input terminal configured to receive the first current, an input terminal configured to receive a control signal, and an output terminal configured to output, as the reference current, a second current having a second current value, wherein a ratio of the second current value to the first current value is set based on the control signal, and wherein the output terminal of the light-receiving element, the output terminal of the conversion unit, and the first input terminal of the comparison unit are connected to each other, and the second input terminal receives a reference voltage.

12. A printing apparatus comprising:

a light-emitting element;

a light-receiving element configured to output a monitor current having a value corresponding to a light-emitting amount of the light-emitting element;

a current generation unit configured to generate a first current having a first current value;

a conversion unit configured to output a second current having a second current value as a reference current upon receiving a control signal and the first current, a ratio of the second current value to the first current value being set based on the control signal;

a comparator which includes a first input terminal connected to both an output terminal configured to output the monitor current of the light-receiving element and an output terminal configured to output the reference current of the conversion unit, and a second input terminal configured to receive a reference voltage; and a driving unit configured to drive the light-emitting element based on an output from the comparator, wherein the conversion unit includes at least two current mirror circuits each receiving the first current.

13. The printing apparatus according to claim 12, wherein each of the at least two current mirror circuits becomes active based on the control signal.

14. The printing apparatus according to claim 13, wherein the conversion unit includes a switch configured to connect the current generation unit and one of the at least two current mirror circuits, and the control signal controls the switch to be turned on or off.

15. The printing apparatus according to claim 14, wherein the comparison unit includes a first input terminal, and each output node of the at least two current mirror circuits is connected to the first input terminal.

16. The printing apparatus according to claim 15, wherein the at least two current mirror circuits have mirror ratios different from each other.

17. The printing apparatus according to claim 16, wherein the comparison unit includes the first input terminal and a second input terminal, the second terminal, an output terminal configured to output the reference current of the conversion unit, and the first input terminal are connected to each other, and the second input terminal receives a reference voltage.

18. The substrate according to claim 11, further comprising a plurality of groups each including the light-emitting element, the comparison unit, and the driving unit, and a selection switch configured to selectively connect, to the light-receiving element, the comparison unit in one of the plurality of groups.

* * * * *